US010014615B2

(12) United States Patent
Mueller et al.

(10) Patent No.: US 10,014,615 B2
(45) Date of Patent: Jul. 3, 2018

(54) CONNECTOR ASSEMBLIES FOR VEHICLE CHARGING

(71) Applicant: Lear Corporation, Southfield, MI (US)

(72) Inventors: Mark Anthony Mueller, Fenton, MI (US); Arthur Lawrence Richards, Livonia, MI (US); Jason Hinds, Waterford, MI (US); David A. Hein, Sterling Heights, MI (US); Paul Castellani, Sterling Heights, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 15/269,006

(22) Filed: Sep. 19, 2016

(65) Prior Publication Data

US 2018/0083381 A1 Mar. 22, 2018

(51) Int. Cl.

| | |
|---|---|
| ***H01R 13/58*** | (2006.01) |
| ***H01R 13/436*** | (2006.01) |
| ***H01R 13/52*** | (2006.01) |
| ***H01R 13/502*** | (2006.01) |
| ***H01R 43/20*** | (2006.01) |
| *H01R 13/639* | (2006.01) |

(52) U.S. Cl.

CPC ..... *H01R 13/436* (2013.01); *H01R 13/502* (2013.01); *H01R 13/5205* (2013.01); *H01R 43/20* (2013.01); *H01R 13/5221* (2013.01); *H01R 13/639* (2013.01)

(58) Field of Classification Search

CPC ... H01R 27/00; H01R 13/639; H01R 13/5221
USPC ..... 439/30, 321, 350, 345, 604, 352
See application file for complete search history.

(56) References Cited

U.S. PATENT DOCUMENTS

| | | | | |
|---|---|---|---|---|
| 6,123,569 | A | 9/2000 | Fukushima et al. | |
| 6,602,090 | B2 | 8/2003 | Kato | |
| 8,206,184 | B2 | 6/2012 | Kwasny et al. | |
| 8,502,499 | B2 * | 8/2013 | Xiao | A61K 31/661 180/65.1 |
| 8,747,143 | B2 * | 6/2014 | Ichio | B60L 11/1818 439/358 |
| 8,834,202 | B2 * | 9/2014 | Kwasny | B60L 11/1818 439/604 |
| 9,509,095 | B2 * | 11/2016 | Ohmura | H01R 13/639 |
| 2011/0212645 | A1 * | 9/2011 | Osawa | H01R 13/502 439/352 |

(Continued)

FOREIGN PATENT DOCUMENTS

JP H10-275653 * 4/1998 ..... B60L 11/1818

*Primary Examiner* — Tho D Ta
*Assistant Examiner* — Thang Nguyen
(74) *Attorney, Agent, or Firm* — Brooks Kushman P.C.

(57) ABSTRACT

A connector subassembly is provided with a terminal housing portion, an electrical components housing portion, a strain relief and a seal. A first retainer is provided on the terminal housing portion and is sized to be retained within a handle housing outlet end. At least one socket extends from the receptacle housing portion forward of the handle housing outlet end. A plurality of conductive terminals is oriented within the at least one socket. A cord extends through a proximal end of the electrical components housing portion through a retaining feature and seal, in electrical communication with the plurality of conductive terminals on the outlet end within the terminal housing portion.

8 Claims, 5 Drawing Sheets

(56) References Cited

U.S. PATENT DOCUMENTS

| | | | | |
|---|---|---|---|---|
| 2012/0129378 | A1* | 5/2012 | Kiko | H01R 13/717<br>439/345 |
| 2013/0052853 | A1 | 2/2013 | Natter et al. | |
| 2015/0042275 | A1 | 2/2015 | Schoener et al. | |
| 2015/0155656 | A1* | 6/2015 | Sugiyama | B60L 11/1818<br>439/370 |
| 2015/0207261 | A1* | 7/2015 | Fukushima | H01R 13/506<br>439/701 |
| 2015/0295344 | A1* | 10/2015 | Sawada | B60L 11/1818<br>439/587 |
| 2016/0028185 | A1* | 1/2016 | Ohmura | H01R 13/5227<br>439/160 |

* cited by examiner

CONNECTOR ASSEMBLIES FOR VEHICLE CHARGING

TECHNICAL FIELD

Various embodiments relate to conductive connector assemblies.

BACKGROUND

One example of an electrical connector for vehicle charging is disclosed in U.S. Patent Application Publication No. 2013/0052853 A1 to Natter et al.

SUMMARY

According to at least one embodiment, a connector subassembly is provided with a terminal housing portion, an electrical components housing portion, a strain relief and a seal. A first retainer is provided on the terminal housing portion and is sized to be retained within the handle housing outlet end. At least one socket extends from the terminal housing portion to extend forward of the handle housing outlet end. A plurality of conductive terminals is oriented within the at least one socket. A cable extends through a proximal end of the electrical components housing portion through a retaining feature and seal in electrical communication with the plurality of conductive terminals on the outlet end within the terminal housing.

According to at least one embodiment, a connector assembly is provided with a terminal housing portion sized to be oriented partially within a handle housing outlet end, with a first retainer sized to be retained within the handle housing outlet end. A plurality of conductive terminals is oriented within the terminal housing portion. A secondary housing portion is in cooperation with the terminal housing portion, with a second retainer. A cord extends through a proximal end of the secondary housing portion in electrical communication with the plurality of conductive terminals, in cooperation with the second retainer.

According to another embodiment, a method to assemble a modular connector assembly provides a connector assembly with a terminal housing portion sized to be oriented partially within a handle housing outlet end, with a first retainer sized to be retained within the handle housing outlet end. A plurality of conductive terminals is oriented within the terminal housing portion. A secondary housing portion is in cooperation with the terminal housing portion, with a second retainer. A cord extends through a proximal end of the secondary housing portion in electrical communication with the plurality of conductive terminals, in cooperation with the second retainer. One of a plurality of handle housings is selected comprising single handle housings, multiple housings, and mold-over construction housings, each sized to receive the connector assembly. The connector assembly is retained within the handle housing.

According to at least one embodiment, a connector assembly is provided with a handle housing forming an exterior, a proximal handle housing cable inlet end, and an outlet end. A terminal housing portion is sized to be oriented partially within the handle housing outlet end. A plurality of conductive terminals is oriented within the terminal housing portion. A secondary housing portion is in cooperation with the terminal housing portion, with a first retainer. A cord extends through a proximal end of the second housing portion in electrical communication with the plurality of conductive terminals and in cooperation with the first retainer. A second retainer is in cooperation with the proximal handle housing cable inlet end and the cord.

According to at least another embodiment, a method to assemble a modular connector assembly provides a connector assembly with a handle housing forming an exterior, a proximal handle housing cable inlet end, and an outlet end. A terminal housing portion is sized to be oriented partially within the handle housing outlet end. A plurality of conductive terminals is oriented within the terminal housing portion. A secondary housing portion is in cooperation with the terminal housing portion, with a first retainer. A cord extends through a proximal end of the second housing portion in electrical communication with the plurality of conductive terminals and in cooperation with the first retainer. A second retainer is in cooperation with the proximal handle housing cable inlet end and the cord. One of a plurality of handle housings is selected comprising single handle housings, multiple housings, and mold-over construction housings, each sized to receive the connector assembly. The connector assembly is retained within the handle housing.

According to at least one embodiment, a connector assembly is provided with a handle housing forming an exterior, a proximal handle housing cable inlet end, and an outlet end. A terminal housing portion is oriented partially within the handle housing outlet end. A plurality of conductive terminals is oriented within the terminal housing portion. A cord extends through a proximal end of the terminal housing portion in electrical communication with the plurality of conductive terminals, and extends through the proximal handle housing cable inlet end. A first retainer is in cooperation with the terminal housing portion and the cord.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Vehicle charge connector assemblies may vary for each Original Equipment Manufacturer (OEM). Vehicle charge connector assemblies may vary for each jurisdiction as well. However, there are some features of vehicle charge connector assemblies that are common for various OEMs. Likewise there are some features of vehicle charge connector assemblies that are common for various jurisdictions.

Figure 1:
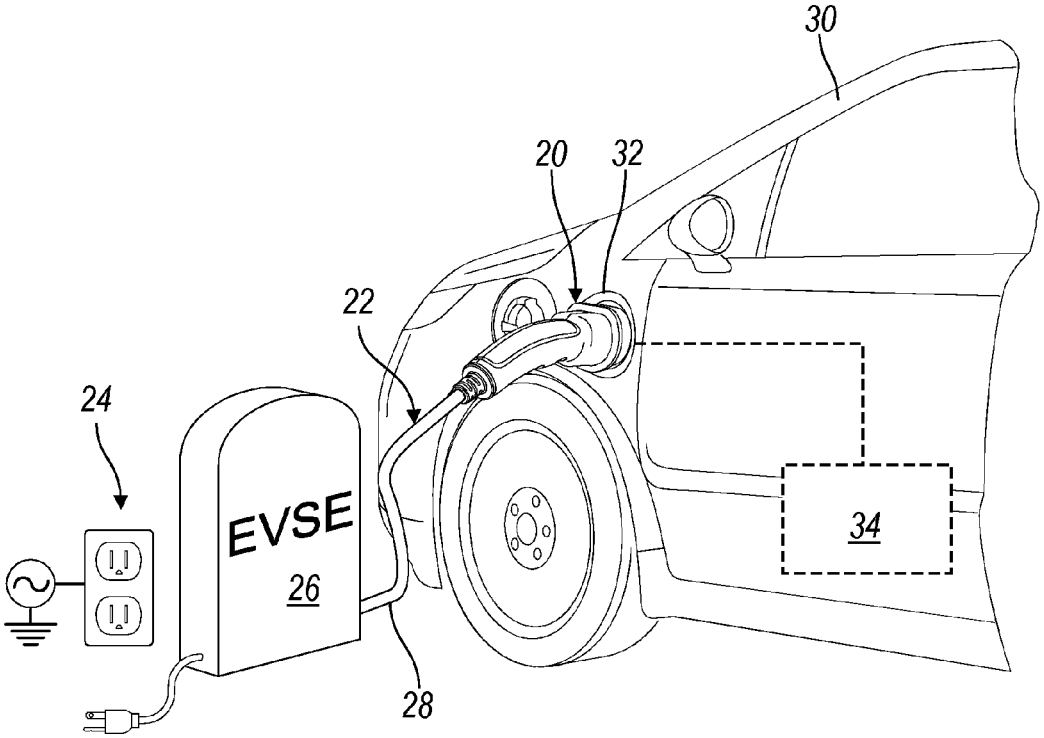
FIG. 1 is a perspective view of a connector assembly according to an embodiment illustrated in cooperation with a vehicle and a power supply.

With reference to FIG. 1, a connector assembly for facilitating electric charging of a vehicle is illustrated in accordance with an embodiment and is referenced generally by numeral 20. The connector assembly 20 is included in a cordset assembly 22, according to one or more embodiments. The cordset assembly 22 includes a connector for connecting to an external power supply 24 for receiving electrical energy. The external power supply 24 represents an alternating current (AC) electrical power supply, such as a standard residential power circuit. The cordset assembly 22 includes electric vehicle supply equipment (EVSE) 26 and a charging cable 28. The charging cable 28 extends between the EVSE 26 and the connector assembly 20. The EVSE 26 is configured to monitor electrical energy passing through the cable 28 during charging. The cordset assembly 22 may be configured to be portable (as shown in FIG. 1) or fixed to a charging station (not shown).

The connector assembly 20 attaches to a vehicle 30, such as a "plug-in" electric vehicle, for supplying electrical energy to the vehicle 30. The vehicle 30 includes a vehicle charging receptacle 32 that is connected to a battery 34 for receiving and storing electrical energy. The vehicle charging receptacle 32 is mounted to be externally accessible from the vehicle 30. The vehicle receptacle 32 receives the connector assembly 20. The battery 34 is electrically connected to the charging receptacle 32 for storing electrical power. The vehicle 30 may also include a converter (not shown) for converting AC to DC electrical power for storage in the battery 34. The vehicle 30 may be an electric vehicle, or any suitable vehicle that receives external electric power.

Figure 2:
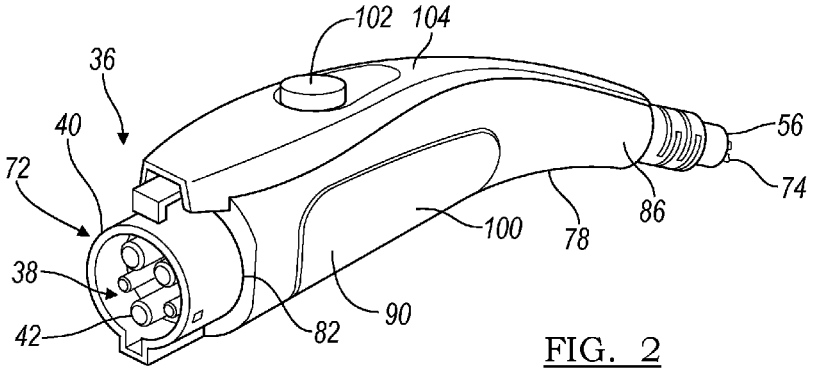
FIG. 2 is a perspective view of a connector assembly according to an embodiment.
Figure 3:
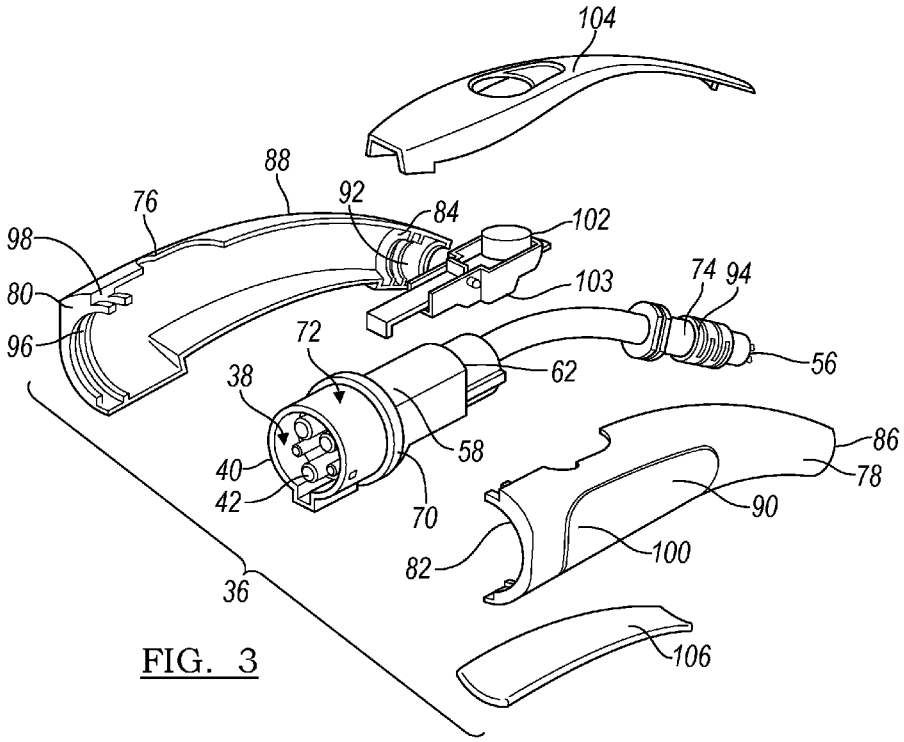
FIG. 3 is an exploded perspective view of the connector assembly of FIG. 2.
Figure 4:
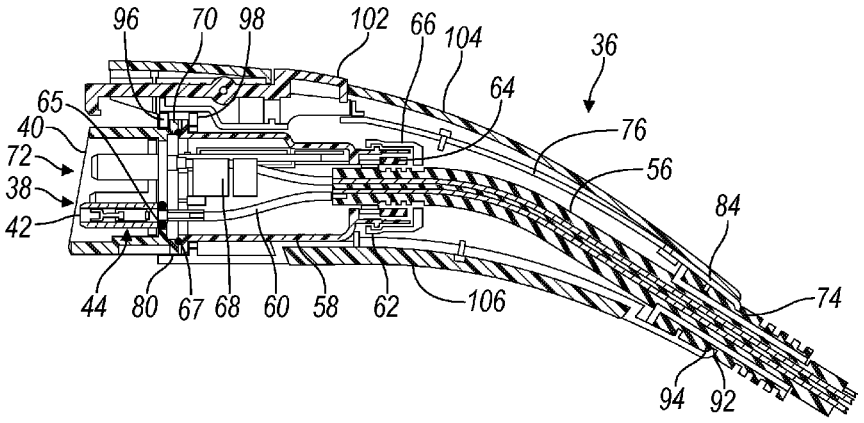
FIG. 4 is longitudinal section view of the connector assembly of FIG. 2.

Referring now to FIGS. 2-4, a connector assembly 36 is illustrated according to an embodiment. The connector assembly 36 includes a forward terminal housing portion 38 that has an external socket 40 that is sized to be received within the vehicle charging receptacle 32. The forward terminal housing portion 38 includes a plurality of recessed sockets 42 that are each sized to receive an electrical connector, such as a terminal assembly 44.

Figure 5:
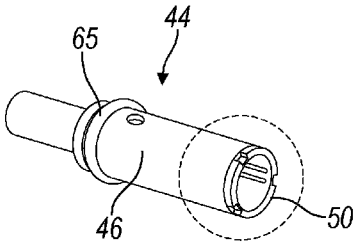
FIG. 5 is a perspective view of a terminal assembly of the connector assembly of FIG. 2, according to an embodiment.
Figure 6:
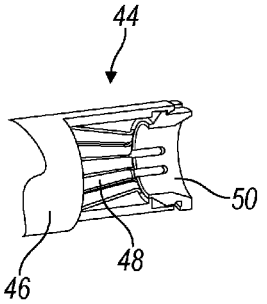
FIG. 6 is an enlarged fragmentary perspective view of the terminal assembly of FIG. 5.
Figure 7:
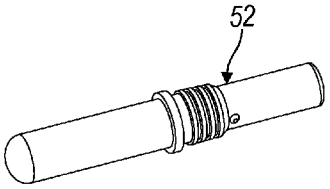
FIG. 7 is a perspective view of a terminal assembly according to an embodiment.
Figure 8:
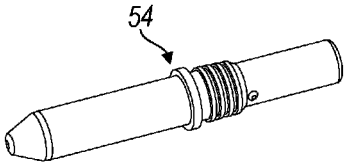
FIG. 8 is a perspective view of a terminal assembly according to another embodiment.

The terminal assemblies 44 are illustrated in FIGS. 4-6. The terminal assemblies 44 are conductive terminals that include a conductive receptacle body 46 with a conductive spring 48 retained by an end cap 50. The terminal assemblies 44 are illustrated and explained in further detail in Mott et al. U.S. Pat. No. 8,840,436 B2, and Mott et al. U.S. Pat. No. 8,808,039 B2, which are incorporated in their entirety by reference herein. The terminal assemblies 44 are sized to receive another conductive terminal, such as a conductive pin 52 of FIG. 7, or a conductive pin 54 of FIG. 8. The conductive pins 52, 54 are provided in the vehicle charging receptacle 32. Conductive pins 52, 54 are further explained in Pusch et al. U.S. Pat. No. 9,013,319 B2, and Natter U.S. Pat. No. 9,331,416 B2, which are incorporated in their entirety by reference herein.

By inserting the socket 40 into the vehicle charging receptacle 32, the terminal assemblies 44 are aligned with the pins 52, 54; and the pins 52, 54 are received within the recessed sockets 42 and consequently the terminal assemblies 44 thereby making electrical connection between the cordset assembly 22 and the vehicle 30. Although female terminal assemblies 44 are illustrated and described, the invention contemplates any conductive connectors for the connector assembly 36. Alternatively, the forward terminal portion 38 may retain the male pin connectors 52, 54.

Referring again to FIGS. 3 and 4, a cord 56 extends through a rearward electrical component housing portion 58, with wires 60 that are directly wired to the terminal assemblies 44. The forward terminal housing portion 38 and the rearward electrical component housing portion 58 are mated to enclose the exposed wires 60. The forward terminal housing portion 38 and the rearward electrical component housing portion 58 may be welded or otherwise fastened together to provide a sealed connection to minimize contamination and corrosion to the wires 60.

Additionally, an inlet end 62 of the rearward electrical component housing portion 58 has a threaded opening for the cord 56 to pass. An elastomeric seal 64 (FIG. 4) is retained about the cord 56 by a threaded nut 66. Another elastomeric seal 65 (FIGS. 4 and 5) is placed on the terminal assembly 44 to seal the terminal housing portion 38. Another elastomeric seal 67 (also in FIG. 4) is secured between the forward terminal housing portion 38 and the rearward electrical component housing portion 58. The elastomeric seals 64, 67 seal the forward terminal housing portion 38 and the rearward electrical component housing portion 58. The seal 64 at the inlet end 62 also retains the cord 56 to provide strain relief to the wires 60. Other electrical components, such as a printed circuit board (PCB) 68 (FIG. 4) may also be housed within the connector subassembly 72. According to another embodiment, a wire management insert may be employed to secure wires and electrical components (such as resistors, switches, etc.) in lieu of a PCB 68. According to yet another embodiment, a microswitch may be utilized in lieu of reed style switch, and therefore a seal 69 (FIG. 10) is provided.

The terminal housing portion 38 and the electrical component housing portion 58 provide a compact connector assembly 36 in comparison to the prior art. The terminal housing portion 38 and the electrical component housing portion 58, along with the terminal assembly seal 65, and the microswitch seal 69, completely seal the terminal assemblies 44 in comparison to the prior art. A smaller volume is sealed thereby minimizing corrosion and contamination. The cord 56 is retained and sealed proximal to the terminal assemblies 44, thereby reducing a length of the cord 56 that is under strain relief, which further reduces potential damage and leaks.

The terminal housing portion 38 and the electrical component housing portion 58 collectively provide an annular ring 70 for retention of the terminal housing portion 38 and the electrical component housing portion 58 within another housing. The compact and sealed terminal housing portion 38 and electrical housing portion 58 provide a fully assembled and sealed connector subassembly 72 that is modular and standardized for utilization in multiple connector assemblies, such as varying for particular makes, models and jurisdictions.

According to at least one embodiment, the connector assembly 36 may also include a grommet 74 upon the charging cable or cord 56. The grommet 74 provides cable management and secondary sealing upon the cable 56 and further prevents the connection of the cable 56 to the terminal assemblies 44 from distributing forces that may affect, or disconnect, the connections.

The connector assembly 36 includes a first handle housing portion 76 and a second handle housing portion 78. The handle housing portions 76, 78 each include an outlet end 80, 82 and an inlet end 84, 86, with a handle region 88, 90 extending between the outlet ends 80, 82 and the inlet ends 84, 86. The first handle housing portion 76 and the second handle housing portion 78 are similar, yet nearly opposite of each other, for assembly in a clamshell configuration. Other variants may include, but are not limited to upper and lower housings, one-piece designs, overmolded designs, and multi-piece housings.

The inlet ends 84, 86 of the handle housing portions 76, 78 each have an inward extending inlet end retainer 92 for engaging a recess 94 in the grommet 74 for retaining the grommet 74 and the cable 56 within the inlet ends 84, 86 of the handle housing portions 76, 78. According to at least one embodiment, multiple retainers 92 may be provided for various grommet and cable sizes as is described in Natter et al. U.S. Patent Application Publication No. 2013/0052853 A1, which is incorporated by reference herein.

The handle housing portions 76, 78 each have an outlet end retainer 96 with a groove 98 adjacent the outlet ends 80, 82 for receipt of the annular ring 70 of the connector subassembly 72. The first handle housing portion 76 and the second handle housing portion 78 are assembled together for retaining the cable management 74 and the cable 56 at the inlet ends 84, 86; and for retaining the connector subassembly 72 at the outlet ends 80, 82. Once assembled, the handle regions 88, 90 collectively provide a handle for manual control of the connector assembly 36. The handle housing portions 76, 78 collectively provide an exterior 100 for the connector assembly 36.

The connector subassembly 72 is a sealed module that permits configuration and customization of the external handle housing portions 76, 78 to meet various OEM and jurisdictional specifications and requirements without an overall redesign of the functional requirements. This modularity minimizes design time and costs. The connector subassembly 72 is designed to meet roll-over capability specifications, while providing strain relief to the cable 56. By providing the wires 60 and the PCB 68, according to another embodiment, a wire management insert may be employed to secure wires and electrical components (such as resistors, switches, etc.) in lieu of a PCB 68, in the connector subassembly 72, a focused volume of the overall connector assembly 36 is sealed. Contamination and damage of these components is minimized by the compact sealed connector subassembly 72. The connector subassembly 72 avoids any need for sealing the entire handle housing portions 76, 78 by separating, containing, and sealing the electrical components 38 within the sealed connector subassembly 72.

The handle housing portions 76, 78 may be designed for a particular set of vehicle and geographic specifications with a tapered and curved handle. A latch mechanism 102 may be provided for attachment to the corresponding vehicle. A latch cover 104 may also be provided for concealing components of the latch mechanism 102. A grip pad 106 may also be provided to add comfort to the exterior of the connector assembly 36. According to another embodiment, the latch cover 104 and a base 103 of the latch mechanism 102 may be incorporated or molded with the connector subassembly 72. Other variants may include, but are not limited to: upper and lower housings, one-piece designs, mold-over designs, and multi-piece housings.

Figure 9:
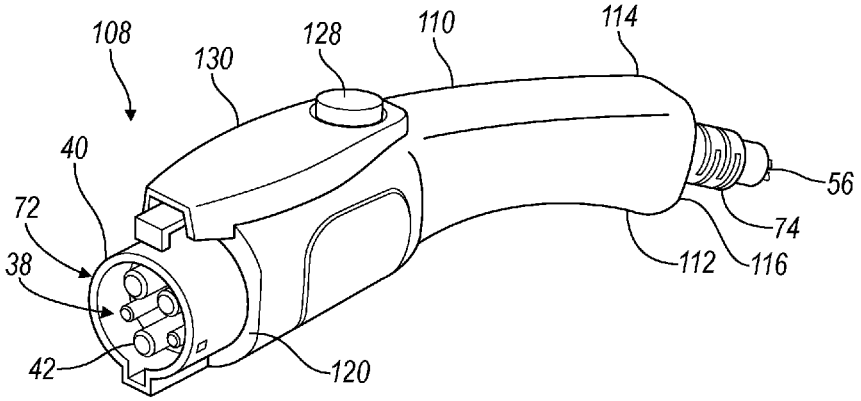
FIG. 9 is a perspective view of a connector assembly according to another embodiment.
Figure 10:
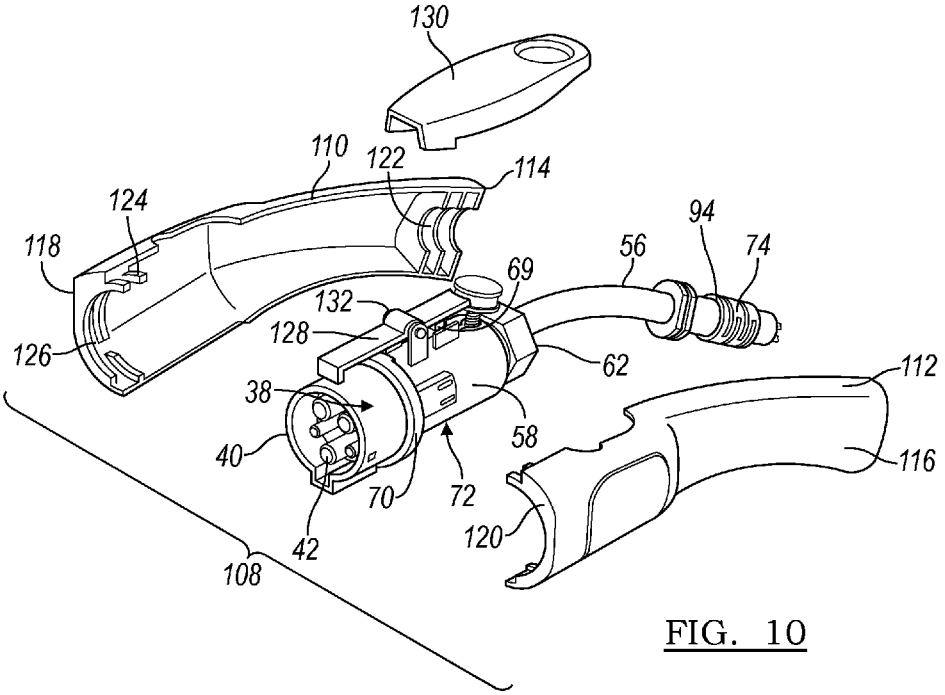
FIG. 10 is an exploded perspective view of the connector assembly of FIG. 9.

FIGS. 9 and 10 illustrate a connector assembly 108 according to another embodiment. The connector assembly 108 includes a pair of handle housing portions 110, 112 for cooperation with the connector subassembly 72. The handle housing portions 110, 112 are angled with an obtuse angle between an inlet end 114, 116 and an outlet end 118, 120. An inlet end retainer 122 is provided for retaining the grommet 74. An outlet end retainer 124 is provided with a groove 126 to engage the annular ring 70 of the connector subassembly 72. A latch mechanism 128 may be provided for attachment to the corresponding vehicle. A latch cover 130 may also be provided for concealing components of the latch mechanism 128. According to another embodiment, the latch cover 130 and a base 132 of the latch mechanism 128 may be incorporated or molded with the connector subassembly 72. Other variants may include, but are not limited to: upper and lower housings, one-piece designs, mold-over designs, and multi-piece housings.

Figure 11:
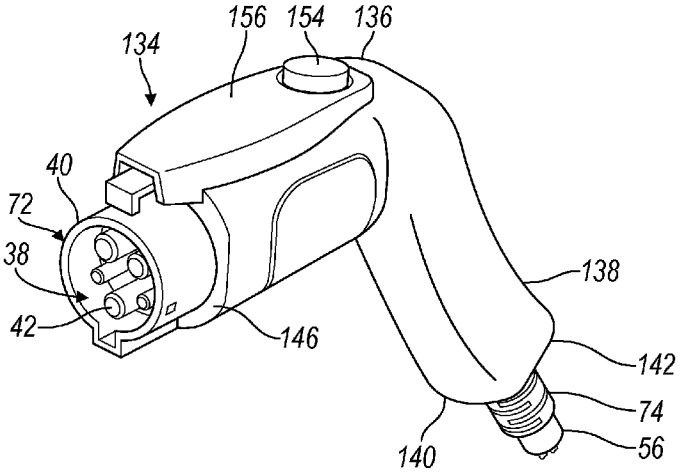
FIG. 11 is a perspective view of a connector assembly according to another embodiment.
Figure 12:
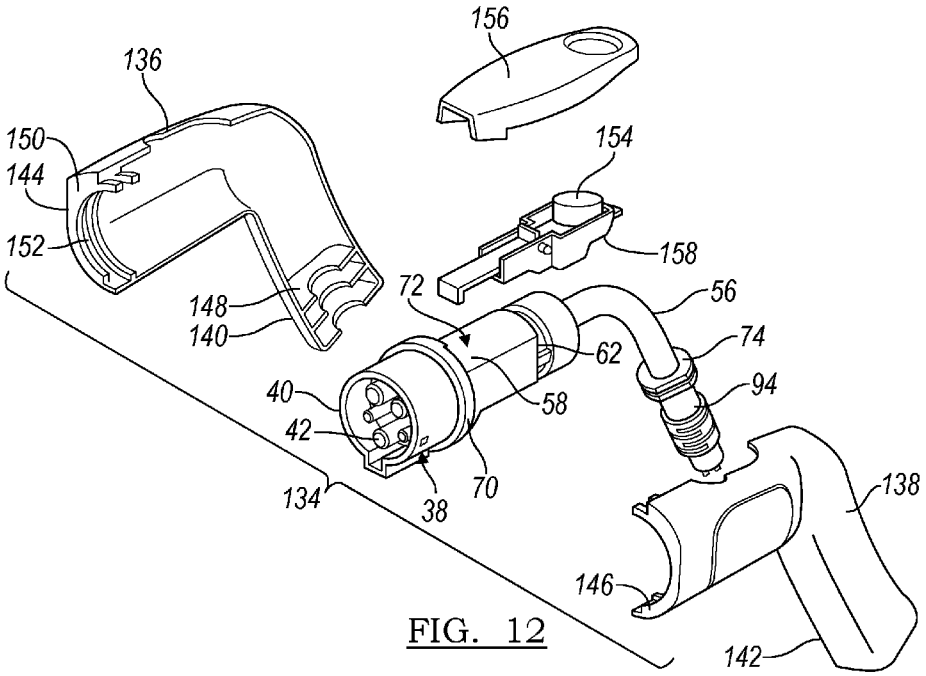
FIG. 12 is an exploded perspective view of the connector assembly of FIG. 11.

FIGS. 11 and 12 illustrate a connector assembly 134 according to yet another embodiment. The connector assembly 134 includes a pair of handle housing portions 136, 138 for cooperation with the connector subassembly 72. The handle housing portions 136, 138 are angled at a slight obtuse angle between an inlet end 140, 142 and an outlet end 144, 146. An inlet end retainer 148 is provided for retaining the grommet 74. An outlet end retainer 150 is provided with a groove 152 to engage the annular ring 70 of the connector subassembly 72. A latch mechanism 154 may be provided for attachment to the corresponding vehicle. A latch cover 156 may also be provided for concealing components of the latch mechanism 154. According to another embodiment, the latch cover 156 and a base 158 of the latch mechanism 154 may be incorporated or molded with the connector subassembly 72. Other variants may include, but are not limited to: upper and lower housings, one-piece designs, mold-over designs, and multi-piece housings.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A connector assembly comprising:

a terminal housing portion sized to be oriented partially within a handle housing outlet end, with a first retainer sized to be retained within the handle housing outlet end;

a plurality of conductive terminals oriented within the terminal housing portion;

a secondary housing portion in cooperation with the terminal housing portion, with a second retainer;

a cord extending through a proximal end of the secondary housing portion in cooperation with the second retainer;

a plurality of wires extending through the cord in electrical communication with the plurality of conductive terminals; and a handle housing forming an exterior, an outlet end in cooperation with the terminal housing portion and the first retainer, and a proximal handle housing cable inlet end in cooperation with the cord;

wherein the second retainer is enclosed within the handle housing; and wherein the second retainer comprises a threaded fastener.

2. The connector assembly of claim 1 further comprising a cable management system in cooperation with the proximal handle housing cable inlet end and the cord.

3. The connector assembly of claim 2 wherein the cable management system comprises a grommet.

4. The connector assembly of claim 1 wherein the first retainer comprises an annular ring extending about the terminal housing portion.

5. The connector assembly of claim 4 wherein the handle housing is formed with a groove sized to receive the annular ring of the terminal housing portion.

6. The connector assembly of claim 1 wherein the handle housing provides an external grip surface that extends relative to the terminal housing portion.

7. A method to assemble a modular connector assembly comprising:

providing the connector assembly according to claim 1;

selecting one of a plurality of handle housings comprising single handle housings, multiple housings, and mold-over construction housings, each sized to receive the connector assembly; and retaining the connector assembly within the handle housing.

8. The connector assembly of claim 1 wherein the secondary housing portion comprises an electrical components housing portion.

* * * * *